US006739102B2

(12) United States Patent
Roy, Sr.

(10) Patent No.: US 6,739,102 B2
(45) Date of Patent: May 25, 2004

(54) METHOD AND APPARATUS FOR FORMING A CONCRETE FOUNDATION WALL

(76) Inventor: Marc Roy, Sr., 15 Spruce St., Middleboro, MA (US) 02346

( * ) Notice: Subject to any disclaimer, the term of this patent is extended or adjusted under 35 U.S.C. 154(b) by 26 days.

(21) Appl. No.: 09/961,127

(22) Filed: Sep. 21, 2001

(65) Prior Publication Data

US 2003/0056462 A1 Mar. 27, 2003

(51) Int. Cl.[7] ..... E04G 11/00; E04G 17/00; E04G 21/00

(52) U.S. Cl. ..... 52/294; 852/309.12; 852/741.13; 852/742.14; 852/295; 852/309.11; 249/34; 249/40; 249/216

(58) Field of Search ..... 52/294, 309.12, 52/741.13, 742.14, 292, 293.1, 293.2, 293.3, 295, 309.1, 309.8, 309.11, 309.7; 249/34, 40, 216

(56) References Cited

U.S. PATENT DOCUMENTS

| | | | | | |
|---|---|---|---|---|---|
| 3,374,984 | A | * | 3/1968 | Mueller | 249/216 |
| 3,398,982 | A | * | 8/1968 | Venzie, Jr. | 52/714 |
| 3,552,076 | A | | 1/1971 | Gregori | 52/295 |
| 3,788,020 | A | | 1/1974 | Gregori | 52/309 |
| 4,070,845 | A | * | 1/1978 | Cody | 52/632 |
| 4,229,920 | A | | 10/1980 | Lount | 52/309.12 |
| 4,257,571 | A | * | 3/1981 | Franks | 249/207 |
| 4,291,858 | A | * | 9/1981 | NeSmith | 249/216 |
| 4,426,061 | A | | 1/1984 | Taggart | 249/45 |
| 4,516,372 | A | | 5/1985 | Grutsch | 52/309.12 |
| 4,587,774 | A | * | 5/1986 | Wendt | 52/36.6 |
| 4,706,429 | A | | 11/1987 | Young | 52/309.12 |
| 4,805,366 | A | * | 2/1989 | Long | 52/309.11 |
| 4,888,931 | A | | 12/1989 | Meilleur | 52/426 |
| 4,924,641 | A | | 5/1990 | Gibbar, Jr. | 52/204 |
| 5,038,541 | A | | 8/1991 | Gibbar, Jr. | 52/295 |
| 5,040,344 | A | | 8/1991 | Durand | 52/127.2 |
| 5,323,578 | A | * | 6/1994 | Chagnon et al. | 52/426 |
| 5,809,725 | A | | 9/1998 | Cretti | 52/426 |
| 5,861,105 | A | | 1/1999 | Martineau | 249/44 |
| 5,956,922 | A | * | 9/1999 | Liuska | 52/745.09 |
| 5,992,114 | A | * | 11/1999 | Zelinsky et al. | 52/426 |
| 6,016,633 | A | * | 1/2000 | Elwart | 52/294 |
| D435,212 | S | | 12/2000 | Philippe | D8/354 |
| 6,167,671 | B1 | | 1/2001 | Wilson | 52/654.1 |

OTHER PUBLICATIONS

Phil–Insul Corp. IntegraSpec Brochure.

* cited by examiner

*Primary Examiner*—Jeanette E. Chapman
(74) *Attorney, Agent, or Firm*—Bromberg & Sunstein LLP

(57) ABSTRACT

A method and apparatus for forming a concrete foundation wall. A trench is opened in the ground and a form is inserted into the trench. The form is made up of a pair of spaced-apart opposing panels, which define a cavity. The panels may be made of a thermal insulating material, which may be extruded foam insulation or, more particularly, extruded polystyrene. The panels may be supported through a combination of J-channels, spreader brackets, connecting members, and a support member. The method further includes backfilling the trench around the form with dirt and pouring concrete into the cavity. The dirt provides support for the form as the concrete is poured.

34 Claims, 6 Drawing Sheets

METHOD AND APPARATUS FOR FORMING A CONCRETE FOUNDATION WALL

TECHNICAL FIELD

The present invention relates in general to concrete forms and, in particular, to the formation of concrete foundation walls.

BACKGROUND ART

In the construction industry, concrete foundation walls are made by using forms. Typical forms are made of spaced-apart opposing panels of plywood secured together by metal ties or rods. Concrete is then poured into the cavity formed by the spaced-apart panels and after it hardens the plywood is removed. Foam panels may also be inserted to provide insulation for the wall. The metal ties remain in the concrete to strengthen the wall.

Many modern forms use plastic or foam boards instead of or in addition to plywood. The plastic or foam boards act as insulation after the concrete is poured. However, these forms generally require additional support members such as external bracing to support the form as the concrete is poured. Examples of such forms may be found in U.S. Pat. No. 5,040,344 (Durand), U.S. Pat. No. 5,861,105 (Martineau), U.S. Pat. No. 4,516,372 (Grutsh), and U.S. Pat. No. 4,888,931 (Meilleur). Moreover, many modern forms require the use of specially manufactured panels, which foreclose the use of more readily available, less expensive standard panels, such as those found in U.S. Pat. No. 4,706,429 (Young) and U.S. Pat. No. 4,229,920 (Lount).

SUMMARY OF THE INVENTION

A method for forming a concrete foundation wall includes opening a trench in the ground and inserting a form into the trench. The form is made up of a pair of spaced-apart opposing panels, which define a cavity. The method further includes backfilling the trench around the form with dirt and pouring concrete into the cavity. The dirt provides support for the form as the concrete is poured. In one embodiment, the panels are made of a thermal insulating material. In other embodiments, the insulating material is extruded foam insulation or, more particularly, extruded polystyrene.

A concrete form includes a pair of opposing panels and a spreader bracket. Each channel of the spreader bracket supports one of the panels a predefined distance apart from the opposing panel. The spreader bracket retains the bottom edges of the panels in a vertical position relative to the ground. In one embodiment, the spreader bracket has a hole in its center for receiving a support member. In another embodiment, the support member is mated to the hole in the spreader bracket. The support member serves to prevent lateral movement of the form as concrete is poured. In another embodiment, the support member is a rebar. In yet another embodiment the form includes a threaded connecting member for connecting the panels and a fastener for securing the connecting member to the panels. In another embodiment, the fastener has a projection for digging into the panels. In another embodiment the panels are made of a thermal insulating material. In other embodiments, the insulating material is foam insulation or, more particularly, extruded polystyrene.

In accordance with a further embodiment, a concrete form includes a pair of opposing panels and a pair of spaced-apart J-channels. Each J-channel has a high side and a low side.

Each J-channel retains a panel. The J-channels separate the panels a given distance from each other. Each channel supports a panel in a vertical position relative to the ground. In one embodiment, the high side of each J-channel is adjacent an inward facing surface of one of the opposing panels and the low side of each channel is adjacent an outward facing surface of one of the opposing panels. In another embodiment the form includes a threaded connecting member for connecting the panels and a fastener for securing the connecting member to the panels. In another embodiment, the fastener has a projection for digging into the panels. In another embodiment, the panels are made of a thermal insulating material. In other embodiments, the insulating material is extruded foam insulation or, more particularly, extruded polystyrene.

A concrete form of another embodiment includes a pair of opposing panels, a pair of J-channels, and a spreader bracket. Each of the opposing panels has a top edge and a bottom edge. The J-channels retain the bottom edges of the panels in a vertical position relative to the ground. Each J-channel has a high side and a low side. The spreader bracket retains the J-channels and separates the J-channels and the panels a predefined distance apart. In one embodiment, the high side of each J-channel is adjacent an inward facing surface of one of the opposing panels and the low side of each channel is adjacent an outward facing surface of one of the opposing panels. In another embodiment, the spreader bracket has a hole in its center for receiving a support member. In another embodiment, the support member is mated to the hole in the spreader bracket. The support member serves to prevent lateral movement of the form as concrete is poured. In another embodiment, the support member is a rebar. In yet another embodiment the form includes a threaded connecting member for connecting the panels and a fastener for securing the connecting member to the panels. In another embodiment, the fastener has a projection for digging into the panels. In another embodiment the panels are made of a thermal insulating material. In other embodiments, the insulating material is extruded foam insulation or, more particularly, extruded polystyrene.

A concrete foundation wall includes concrete extending down into a trench in the ground, thermal insulation panels on opposite sides of the wall, and connecting members extending through the panels and the concrete. The bottom edges of the thermal insulation panels may be secured by channels placed in the trench. In some embodiments, the connecting members are threaded and fasteners are attached to the connecting members against the outer surface of each of the thermal insulation panels. In other embodiments, the channels are J-channels or spreader brackets. In other embodiments, the insulating panels are made out of extruded foam insulation or, more particularly, extruded polystyrene.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Figure 1:
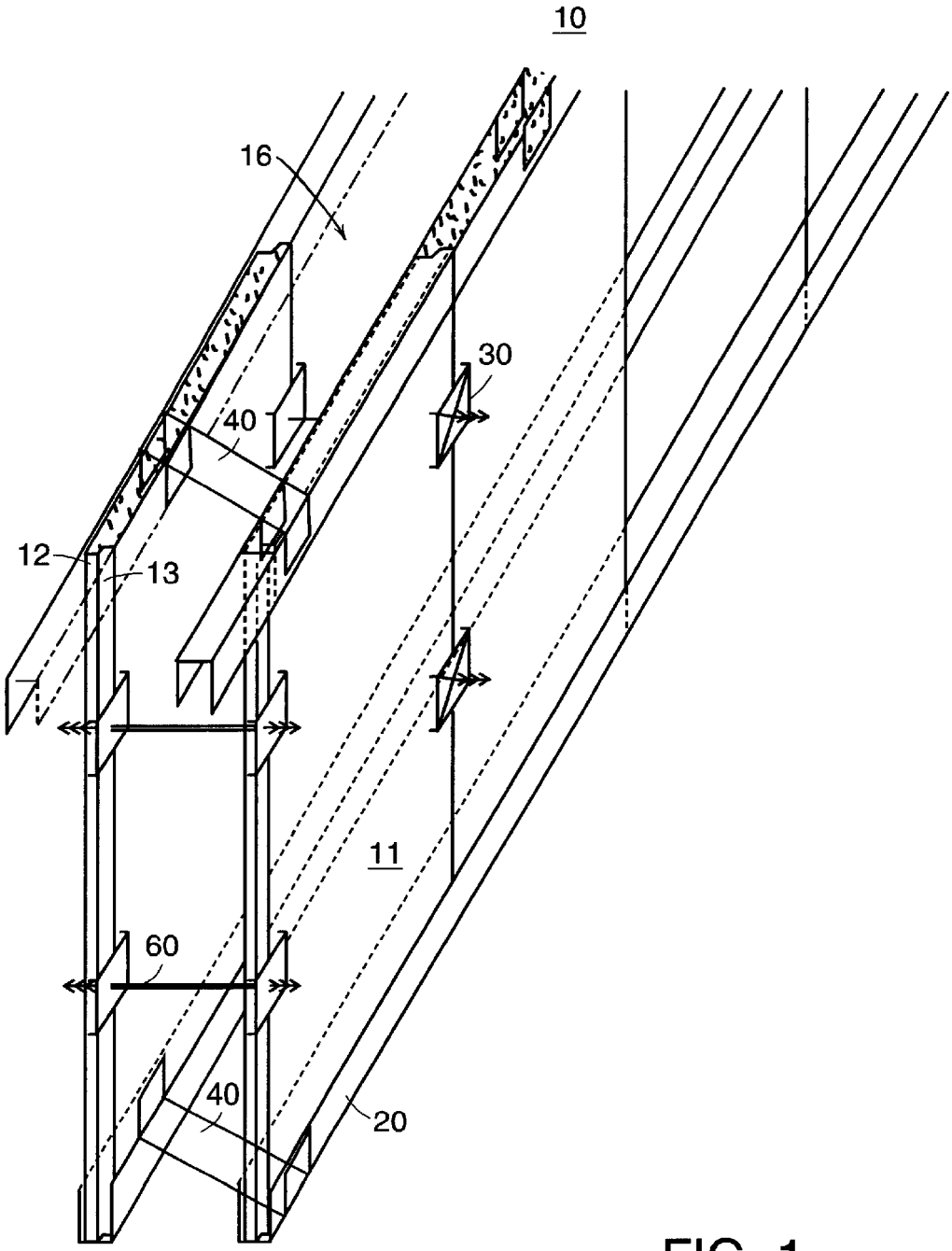
FIG. 1 is a perspective view of a concrete form in accordance with an embodiment of the invention.

FIG. 1 is a perspective view of a concrete form 10 in accordance with an embodiment of the invention. As shown in FIG. 1, the concrete form 10 includes opposing foam panels 11. Panels 11 are commercially available foam boards having standard dimensions. For example, in this embodiment, panels 11 are 24" in width, 48" in height and 2" thick. Panels having other dimensions may also be used. Panels 11 are preferably made out of extruded polystyrene (Styrofoam™) but may be made out of some other thermal insulating material as well. The side edges of each panel 11 are preferably cut in a tongue 12 and slot 13 configuration for interlocking with similarly cut panels 11. In this manner, concrete foundation walls of varying lengths may be formed. In form 10, the top and bottom edge of each opposing panel 11 is secured by a J-channel 20 (which is described in detail below with respect to FIG. 2).

Figure 2:
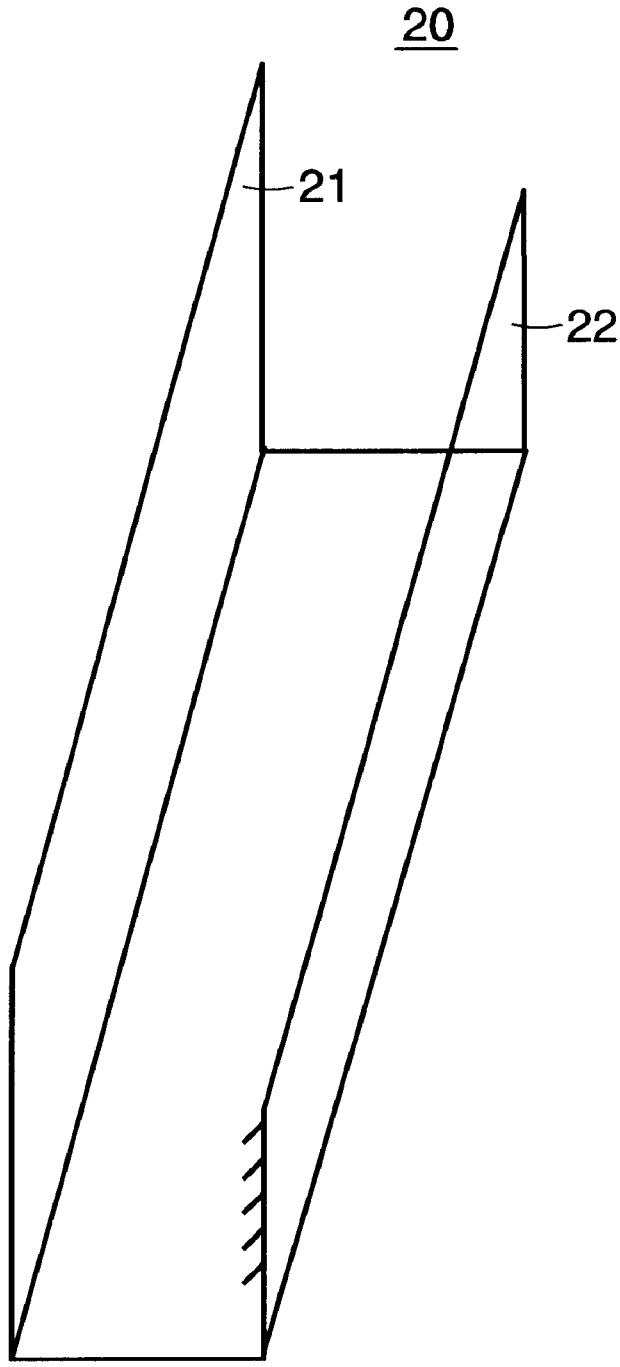
FIG. 2 is a perspective view of a J-channel useable in an embodiment of the invention.

FIG. 2 is a perspective view of J-channel 20. J-channel 20 is an elongated channel having a high side 21 and a low side 22 for receiving and retaining the edge of a panel 11 (as shown in FIG. 1). In a preferred embodiment, J-channel 20 has a width of 2", the high side 21 of J-channel 20 has a height of 4", and the low side 22 has a height of 3". Low side 22 preferably has a series of slanted prongs or teeth, which act as a one-way restraint for a panel 11. Panels 11 inserted into J-channel 20 are retained by the slanted prongs thereby achieving a tight fit. J-channel 20 is preferably made of polyvinyl chloride (PVC) but may also be made of other substantially sturdy materials, such as aluminum. J-channel 20 may be manufactured in various lengths to accommodate a variety of concrete foundation walls.

Figure 6:
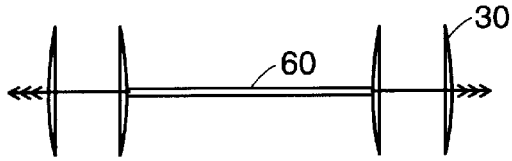

Returning to FIG. 1, in the form 10, J-channels 20 are set a fixed distance apart to define a cavity 16 between opposing panels 11 in which to pour the concrete for the wall. The distance between the J-channels 20 (and thus the width of cavity 16) may be varied depending on the desired width of the concrete wall. Form 10 further includes tie rods 60, which pass through cavity 16 to connect the opposing panels 11 and provide support for the form as concrete is poured. The tie rods 60 serve as connecting members for maintaining the panel walls a given distance apart. In a preferred embodiment, tie rods 60 are made of polyvinyl chloride (PVC), however they may also be made of steel or other suitable material known to those of ordinary skill in the art. In the embodiment shown in FIG. 1, two tie rods 60 are used to connect each pair of opposing panels 11 although more or fewer tie rods 60 may be used for support as desired. In a preferred embodiment, both ends of each tie rod 60 are ratcheted as shown in FIG. 6 to receive a washer 30 at each end to sink into the face of each panel. In another embodiment tie rod 60 may be threaded. In accordance with a preferred embodiment, the washers 30 have a square shape.

Figure 3A:
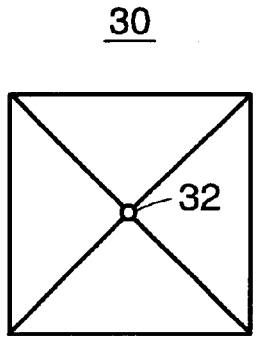
FIG. 3*a* is a perspective view of a square washer having projections useable in an embodiment of the invention.
Figure 3B:
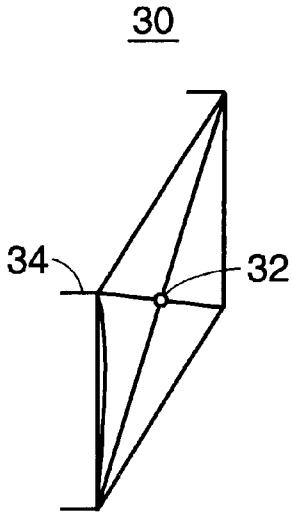
FIG. 3*b* is a front view of a square washer useable in an embodiment of the invention.

FIGS. 3*a* and 3*b* are perspective and front views, respectively, of a square washer 30. Square washer 30 has a substantially flat front surface with a hole 32 in the center for attachment to a tie rod 60 (FIG. 3*a*). Square washer 30 also includes four pins 34 positioned at each corner. The pins 34 are projections which project away from the back of the washer (FIG. 3*b*). In this embodiment, square washer 30 measures 4" on each side, but other dimensions may be used if desired. In a preferred embodiment, square washer 30 is made out of polyvinyl chloride (PVC) because of its environmentally friendly characteristics.

Tie rods 60 and square washers 30 may be used in the middle of opposing panels 11 to support the panels or at the mating edges of two consecutive adjacent panels to support and hold them together. Pins 34 (FIG. 3*a*) of each square washer 30 are pushed into foam panels 11 at the seam created by two adjacent panels so that each washer straddles the panels.

Figure 4A:
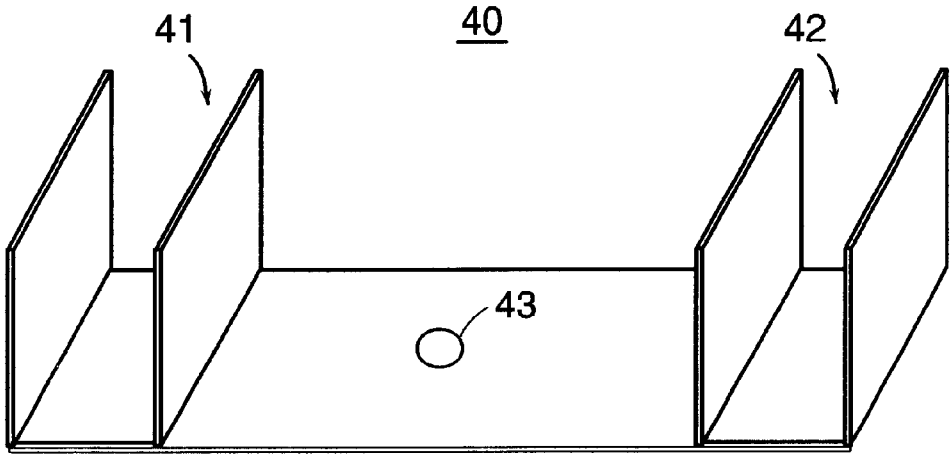
FIG. 4*a* is an isometric view of a spreader bracket useable in an embodiment of the invention.
Figure 4B:
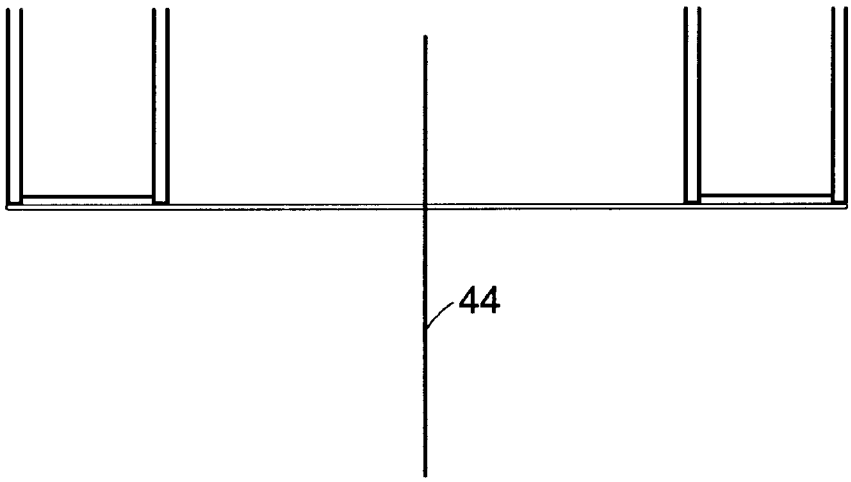
FIG. 4*b* is a front view of the spreader bracket supporting a rebar useable in an embodiment of the invention.

FIG. 4*a* is an isometric view of spreader bracket 40. Spreader bracket 40 has two channels 41 and 42. Channels 41 and 42 are manufactured so that they are sufficiently wide enough to receive and securely hold J-channels 20 (FIG. 1) and the top and bottom edges of panels 11 in form 10 (FIG. 1). Spreader bracket 40 may optionally include a centrally located hole 43, for receiving a support member 44 (FIG. 3*b*) to secure the bottom of a form. FIG. 4*b* is a front view of a spreader bracket 40 for securing the bottom of a form, which shows support member 44 inserted into hole 43. Support member 44 extends above and below hole 43 so that a portion of support member 44 is below the ground. Support member 44 provides additional support by preventing lateral movement of the form 10 (FIG. 1) as concrete is poured into the cavity 16 (FIG. 1). In a preferred embodiment, support member 44 is an industry standard concrete reinforcing bar (rebar) #4, which is 12" in length, although other support members may be used as well.

In the concrete form 10, opposing panels are separated from each other at a distance corresponding to the desired thickness of the concrete wall. In a preferred embodiment, J-channels 20 and spreader brackets 40 are used for setting the distance between the panels 11. The are also used to provide support to the top and bottom edges of the panels 11 when the concrete is poured. As concrete is poured into the cavity, pressure is exerted against the inside of the panels, pushing them outward. J-channels 20 retain the panels 11 in a fixed position while the spreader brackets 40 combat the pressure of the concrete and helps to prevent the panels 11 from bending or breaking. As additional opposing panels are added to the form, spreader brackets 40 and J-channels 20 are used to provide support at the edges of these panels as well. Of course, additional spreader brackets 40 and J-channels 20 may be used to support other portions of the panels 11 as desired.

Figure 5:
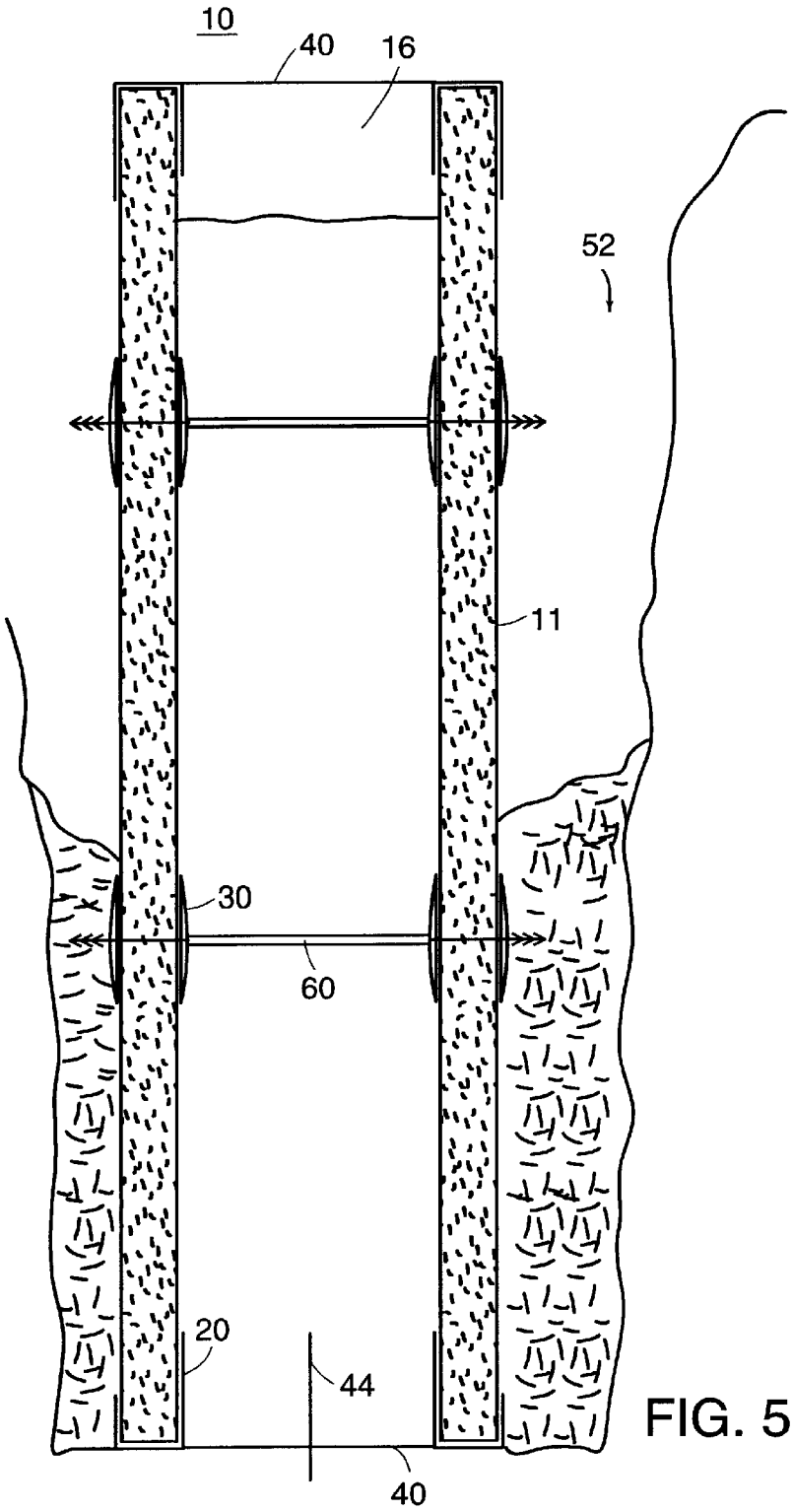
FIG. 5 is a cross section of a concrete foundation wall in accordance with an embodiment of the invention.
Figure 7:
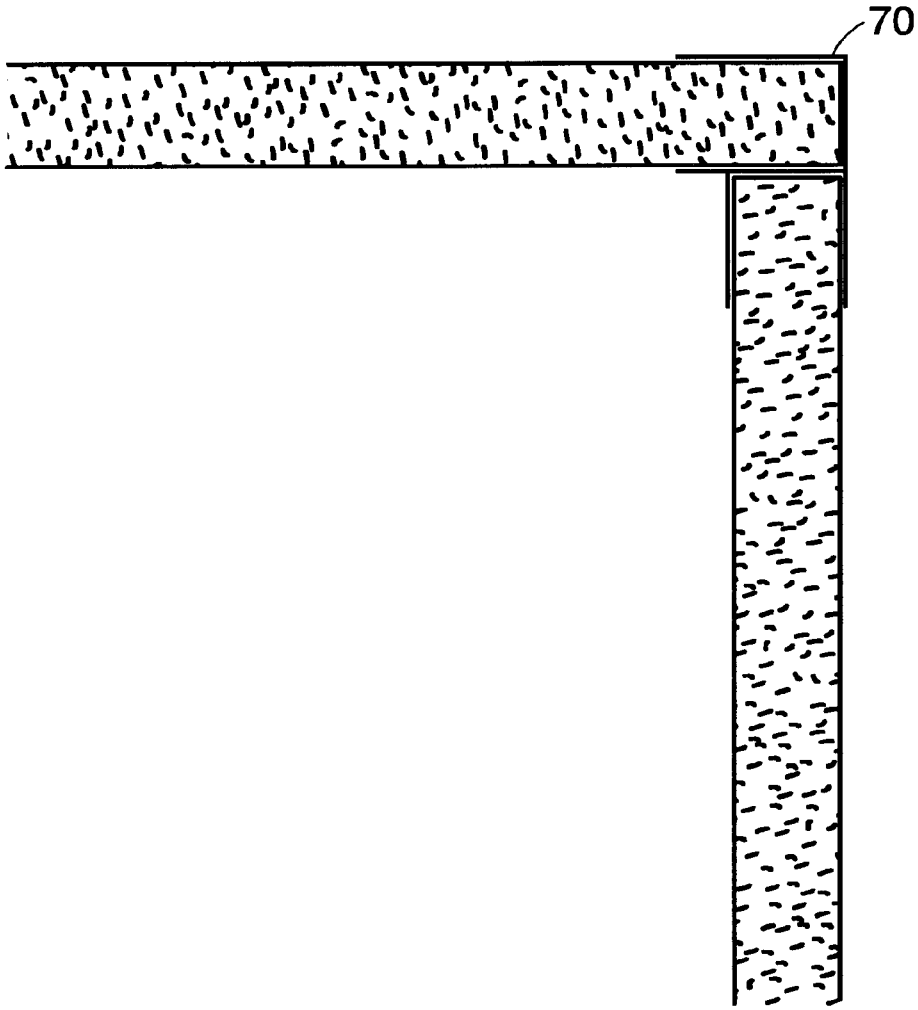

FIG. 5 is a cross section of a concrete foundation wall 50 in accordance with a preferred embodiment of the invention. The wall is formed by opening a narrow trench 52 in the ground, inserting a pair of opposing panels to complete a form 10 in the trench, backfilling the trench around the form with dirt, and pouring concrete into the cavity 16. The backfill and concrete can be alternately built up to maintain the pressure against each face of the panels 11 until the full height of the concrete wall has been poured. In a preferred embodiment, J-channels 20 and a spreader brackets 40 with support member 44 inserted, are used at the top and bottom of the panels 11 to help keep the form rigid as the concrete is poured. Tie rods 60 or other connecting members are inserted across opposing panels 11 to provide additional support to the panel walls. Corners may be formed by inserting the panels 11 into corner piece 70 as shown in FIG. 7. In a preferred embodiment, screws are inserted in the corner piece 70 and through the panels 11 to retain the panels in place. Other retaining means may be used as well.

The resulting foundation wall 50 is composed of concrete poured into the cavity 16 between opposing thermal insulation panels 11. In a preferred embodiment, tie rods 60 extend through the panels 11 and the concrete. Washers 30 are attached to the tie rods 60 against the inner and outer surfaces of each of the opposing thermal insulation panels 11. Backfill from the trench provides support for the wall 50.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

What is claimed is:

1. A concrete form comprising:

a pair of opposing panels, each panel having a top edge and a bottom edge;

at least one spreader bracket, the spreader bracket having dual channels, each channel supporting an edge of one of the panels a predefined distance apart from the opposing panel, the spreader bracket having a hole therein; and a stiff bar for driving into the ground through the hole to prevent lateral movement of the form.

2. The concrete form of claim 1, wherein the hole in the spreader bracket is centrally located.

3. The concrete form of claim 1, further comprising:

a connecting member for connecting the opposing panels, wherein the connecting member is ratcheted at both ends; and a fastener for securing the connecting member to the opposing panels.

4. The concrete form of claim 2, wherein the stiff bar is a rebar.

5. The concrete form of claim 3, wherein the fastener includes a projection pointing into at least one of the opposing panels.

6. The concrete form of claim 1, wherein the opposing panels are made of a thermal insulating material.

7. The concrete form of claim 6, wherein the thermal insulating material is extruded foam insulation.

8. The concrete form of claim 7, wherein the extruded foam insulation is extruded polystyrene.

9. A concrete form comprising:

a pair of opposing panels, each panel having a top edge and a bottom edge;

a pair of spaced apart J-channel, each J-channel having a high side and a low side, each J-channel supporting the bottom edge of one of the panels a given distance from the opposing panel;

slanted prongs in each channel extending into the channel to provide one-way retention of the panels within the channels;

a connecting member for connecting the opposing panels, wherein the connecting member is ratcheted at both ends; and a fastener for securing the connecting member to the opposing panels.

10. The concrete form of claim 9, wherein the high side of each J-channel is adjacent an inward facing surface of one of the opposing panels and the low side of each channel is adjacent an outward facing surface of one of the opposing panels.

11. The concrete form of claim 9, wherein the fastener includes a projection pointing into at least one of the opposing panels.

12. The concrete form of claim 9, wherein the opposing panels are made of a thermal insulating material.

13. The concrete form of claim 12, wherein the thermal insulating material is extruded foam insulation.

14. The concrete form of claim 13, wherein the extruded foam insulation is extruded polystyrene.

15. A concrete form comprising:

a pair of opposing panels, each panel having a top edge and a bottom edge;

a pair of spaced apart J-channels, each J-channel having a high side and a low side, each J-channel supporting an edge of one of the panels a given distance from the opposing panel; and a spreader bracket, the spreader bracket having dual channels, wherein each channel receives and supports one of the J-channels a predefined distance apart from the opposing J-channel, the spreader bracket fixing the position of the J-channels and the opposing panels relative to the ground.

16. The concrete form of claim 14, wherein the high side of each J-channel is adjacent an inward facing surface of one of the opposing panels and the low side of each channel is adjacent an outward facing surface of one of the opposing panels.

17. The concrete form of claim 15, wherein the J-channels further include slanted prongs for providing one-way retention of the panels.

18. The concrete form of claim 15, wherein the spreader bracket has a centrally located hole for receiving a support member.

19. The concrete form of claim 18, wherein the support member is mated to the centrally located hole in the spreader bracket to prevent lateral movement of the form.

20. The concrete form of claim 15, further comprising:

a connecting member for connecting the opposing panels, wherein the connecting member is ratcheted at both ends; and a fastener for securing the connecting member to the opposing panels.

21. The concrete form of claim 18, wherein the support member is a rebar.

22. The concrete form of claim 20, wherein the fastener includes a projection pointing into at least one of the opposing panels.

23. The concrete form of claim 15, wherein the opposing panels are made of a thermal insulating material.

24. The concrete form of claim 23, wherein the thermal insulating material is extruded foam insulation.

25. The concrete form of claim 24, wherein the extruded foam insulation is extruded polystyrene.

26. A concrete form comprising:

a pair of opposing panels, each panel having a top edge and a bottom edge;

at least one spreader bracket, the spreader bracket having dual channels, each channel supporting an edge of one of the panels a predefined distance apart from the opposing panel;

a connecting member for connecting the opposing panels, wherein the connecting member is ratcheted at both ends; and a fastener for moving along the connecting member until being secured with respect to one of the opposing panels by the ratcheting.

27. The concrete form of claim 26, wherein the fastener includes a projection pointing into at least one of the opposing panels.

28. The concrete form of claim 26, further comprising:

slanted prongs in each channel extending into the channel to provide one-way retention of the panels within the channels.

29. A concrete form comprising:

a pair of opposing panels, each panel having a top edge and a bottom edge;

at least one spreader bracket, the spreader bracket having dual channels, each channel supporting an edge of one of the panels a predefined distance apart from the opposing panel wherein the spreader bracket has a hole therein;

slanted prongs in each channel extending into the channel to provide one-way retention of the panels within the channels; and a stiff bar for driving into the ground through the hole in the spreader bracket to prevent lateral movement of the form.

30. A concrete form comprising:

a pair of opposing panels, each panel having a top edge and a bottom edge;

a pair of spaced apart J-channels, each J-channel having a high side and a low side, each i-channel supporting the bottom edge of one of the panels a given distance from the opposing panel;

a connecting member for connecting the opposing panels, wherein the connecting member is ratcheted at both ends; and a fastener for moving along the connecting member until being secured with respect to one of the opposing panels by the ratcheting.

31. The concrete form of claim 30, wherein the fastener includes a projection pointing into at least one of the opposing panels.

32. The concrete form of claim 30, further comprising:

slanted prongs in each J-channel extending into the J-channel to provide one-way retention of the panels within the J-channels.

33. The concrete form of the claim 1, wherein each of the channels is a J-channel having a high side and a low side.

34. The concrete form of claim 33, wherein the high side of a J-channel is adjacent an inward facing surface of one of the opposing panels and the low side of each channel is adjacent an outward facing surface of one of the opposing panels.

* * * * *